United States Patent [19]

Reinkemeyer

[11] 4,264,286

[45] Apr. 28, 1981

[54] MULTIPLE FLUID PUMP

[75] Inventor: Joseph B. Reinkemeyer, Tulsa, Okla.

[73] Assignee: Geosource, Inc., Houston, Tex.

[21] Appl. No.: 864,733

[22] Filed: Dec. 27, 1977

[51] Int. Cl.[3] ..... F04B 21/04

[52] U.S. Cl. ..... 417/539

[58] Field of Search ..... 417/539, 265; 74/579, 74/89-591

[56] References Cited

U.S. PATENT DOCUMENTS

| | | | |
|---|---|---|---|
| 1,018,795 | 2/1912 | Webb | 417/537 |
| 1,070,706 | 8/1913 | Luitwieler | 74/37 |
| 1,109,672 | 9/1914 | Fleming | 417/539 |
| 2,092,641 | 9/1937 | Doran | 417/539 |
| 2,141,057 | 12/1938 | Whiles | 417/248 |
| 2,561,227 | 7/1951 | Reed | 417/238 |
| 2,755,739 | 7/1956 | Euwe | 417/539 |
| 3,595,101 | 7/1971 | Cooper, Sr. | 417/526 |
| 3,667,868 | 6/1972 | Brunner | 417/273 |
| 3,792,939 | 2/1974 | Zalis | 417/539 |
| 3,985,475 | 10/1976 | Gatecliff | 417/539 |

FOREIGN PATENT DOCUMENTS

| | | | |
|---|---|---|---|
| 734284 | 3/1943 | Fed. Rep. of Germany | 417/265 |
| 587743 | 10/1924 | France | 417/265 |
| 818664 | 8/1959 | United Kingdom | 417/539 |
| 1502012 | 2/1978 | United Kingdom | 417/539 |

*Primary Examiner*—William L. Freeh

*Attorney, Agent, or Firm*—Cox & Smith Incorporated

[57] ABSTRACT

A multiple fluid pump for providing multiple output fluid streams at varying pressures with high pressure reciprocating plungers of the pump having equal intervals between their compression strokes to minimize vibrations and shocks in the high pressure output fluid stream and low pressure reciprocating plungers of the pump having their compression strokes intermediate to the high pressure compression strokes.

11 Claims, 5 Drawing Figures

MULTIPLE FLUID PUMP

BACKGROUND OF THE INVENTION

This invention relates generally to a pump apparatus for pumping plural fluids at varying pressures. More specifically, the invention is directed to a pump apparatus for pumping plural fluids at varying high and low pressures. Multiple pumps for pumping a plurality of liquids are known in the prior art. An example of such a pump is shown in U.S. Pat. No. 3,260,211. Also, multiple piston or plunger pumps have previously been used with their pistons or plungers serially connected so as to provide a single high pressure output. An example of a plural cylinder pump is shown in U.S. Pat. No. 3,163,121.

So far as known, it has been a practice in the past to provide even intervals between the compression strokes of multiple plunger pumps. This has been previously done by providing a single drive shaft for a pump and either through the use of a crank or cams evenly dividing the intervals between the strokes of each piston for each revolution of the drive shaft. Such an application has been previously used for pumping a liquid into a single output stream.

SUMMARY OF THE INVENTION

A new and improved multiple fluid pump apparatus for pumping a plurality of liquids at varying pressures. The compression strokes or modes between serially connected high pressure plungers or pistons or other fluids compressing means are evenly spaced for each revolution of a drive shaft or other drive means to minimize vibrations and shocks in the output flow line connected with the pump. Additional low pressure pistons or plungers or other fluid compressing means are driven by the drive shaft to pump one or more fluids at a relatively lower pressure than the high pressure plungers or pistons. The compression strokes or modes of the low pressure plungers are spaced between the intervals of the compression strokes of the high pressure pistons or plungers to minimize the imbalance of the stresses on the drive shaft and vibrations of the system. The high pressure pistons are connected in series to provide a single high pressure output.

The pistons or plungers are connected with the crank with piston rods. The stroke of the high pressure pistons or plungers are equal with the stroke of the low pressure pistons or plungers being less to provide the low pressure output.

DETAILED DESCRIPTION OF THE PREFERRED EMBODIMENT

Figure 1:
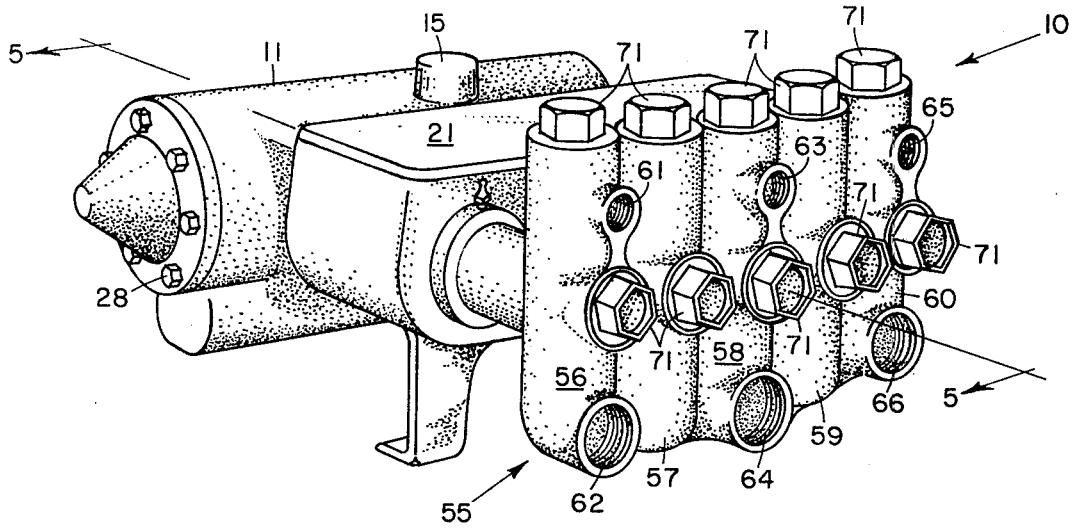
FIG. 1 is a perspective view of the multiple fluid pump apparatus showing a preferred embodiment of the invention.
Figure 4:
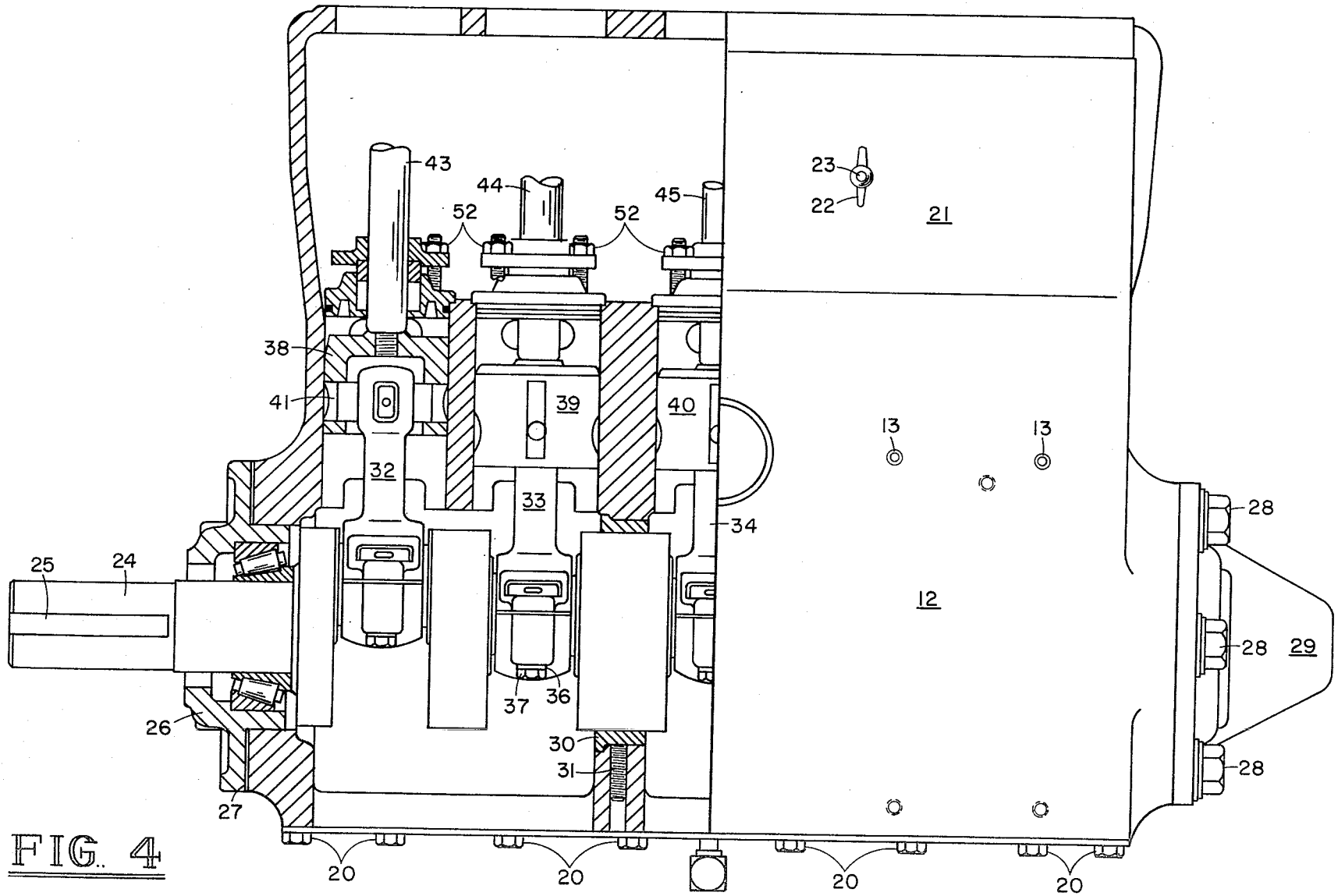
FIG. 4 is a top view, partly in section, showing the crank and rods of the pump apparatus.
Figure 5:
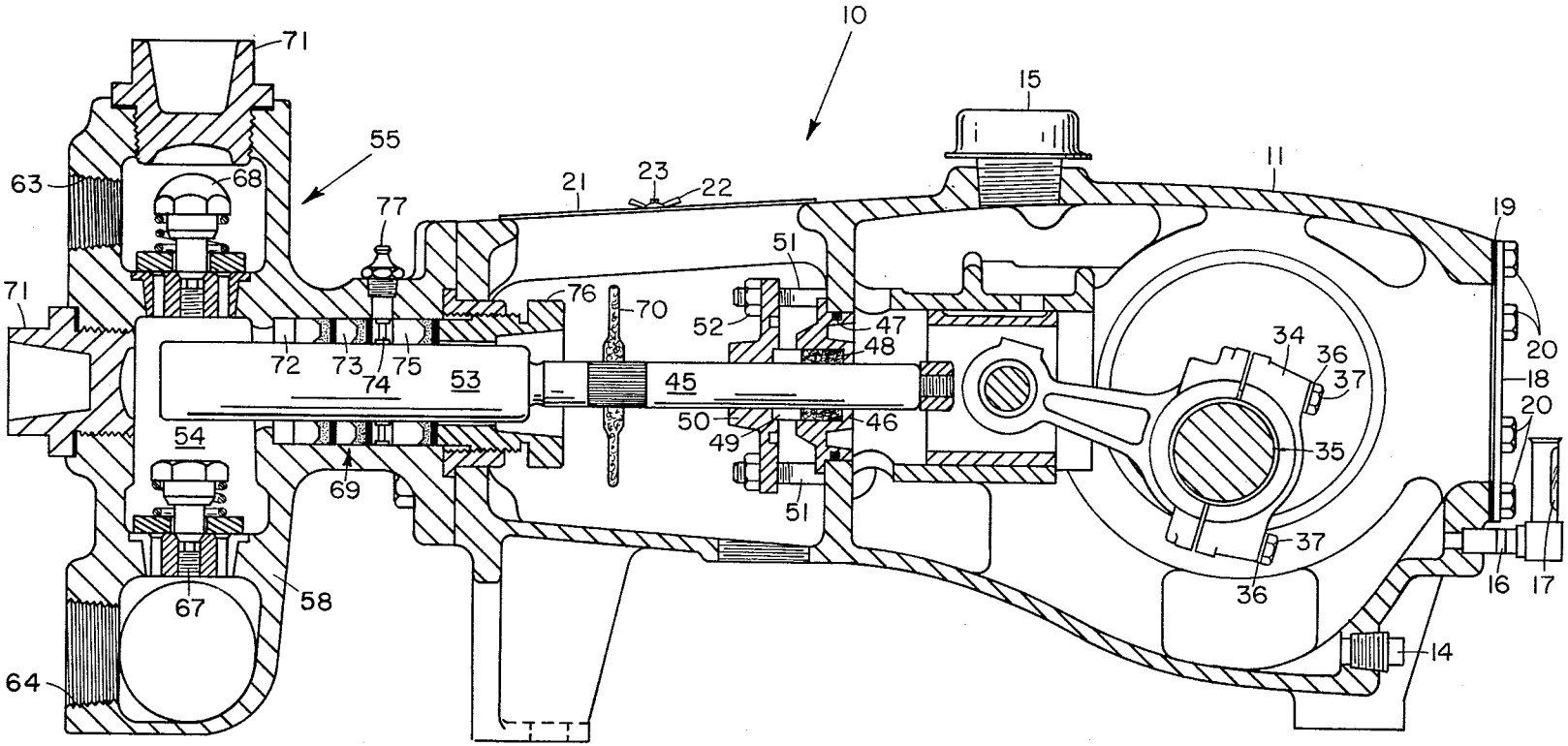
FIG. 5 is crosssectional view taken along Line 5—5 in FIG. 1.

Referring now to the drawings, there is shown an apparatus in accordance with the invention. The apparatus as shown in FIG. 1 is generally designated by the numeral 10. The apparatus 10 has a power frame 11 which supports the drive mechanism of the pump of this invention. The power frame 11 forms an enclosed housing having an upper wall surface 12 as best shown in FIG. 4. The upper wall 12 which includes four plugs 13 (two of which are shown). A drain plug 14 is provided in the housing as shown in FIG. 5 to drain lubricant from the housing. Also shown in FIG. 5, an air filter 15 is provided to vent the housing. A nipple 16 as shown in FIG. 5 is screwed into the housing for mounting an oil gauge 17 thereon to provide a visual indicator of the amount of lubricant in the housing.

An opening in the housing at the right hand side as shown in FIG. 5 is covered by a crankcase cover 18. The crankcase cover 18 is mounted on the housing with a plurality of cap screws 20 which clamp the crankcase cover against a gasket 19 interposed between the crankcase cover and the housing to form a tight seal.

The barrel cover 21 is provided to cover an opening in the upper portion of the housing and is held in place by a nut 22 screwed upon a stud 23 as shown in FIG. 5.

Mounted within the housing is a crankshaft 24 having a square key 25 for attaching a belt pulley or the like for driving the crankshaft. A bearing housing 26 as shown in FIG. 4 is mounted upon the housing with a shim gasket kit, as is well known in the art. Cap screws 28 secure a conventional bearing at the opposite end of the crankshaft. A suitable extension guard 29 may be provided for the right hand end of the crankshaft. A center bearing 30 secured in place with a set screw 31 is provided to further support the crankshaft. Another center bearing (not shown) is also mounted on the crankshaft as will be explained more fully hereinafter.

Connecting rods 32, 33, and 34 are shown in FIG. 4 mounted on the crankshaft. Each connecting rod is mounted on the crankshaft with a bearing 35 (as shown typically in FIG. 5) which mounts the connecting rod 34 on the crankshaft. Bolts 37 having washers 36 thereon secure the connecting rod 34 to the crankshaft. The other connecting rods are similarly secured to the crankshaft.

Connecting rods 32, 33 and 34 are secured to cross-heads 38, 39 and 40, respectively. As shown typically in FIG. 4, a wrist pin 41 secures the cross-head 38 to the connecting rod 32. Although not shown in the drawings, two additional like connecting rods and cross-heads are provided to the right of the three illustrated cross-heads and connecting rods as shown in FIG. 4.

Secured with the cross-heads 38, 39, and 40 are plungers 43, 44, and 45, as best shown in FIG. 4. Two additional plungers (not shown) are provided for the two other cross-heads (not shown). Each plunger extends through a wiper box, each box being identical in construction. As typically shown in FIG. 5, the wiper box 46 which supports the plunger 45 includes an O-ring 47 to effectively seal the wiper box from the lubricated portion of the housing of power frame 11. A packing 48 is mounted with the wiper box to prevent oil from escaping past the plunger 45 out of the enclosed portion of the housing. A follower 49 is also provided with the packing 48. A conventional gland 50 secures the follower and packing in place and may be adjusted by a plurality of studs 51 and nuts 52. Tightening of the nuts 52 compresses the packing to form an oil-tight seal, as is well known in the art.

Secured with each plunger is a fluid compressing head portion, one of which, 53, is shown in FIG. 5. The fluid compressing head portion 53 forms an extension of the plunger 45. Each fluid compressing head portion extends into a compression chamber such as the compression chamber 54 shown in FIG. 5. A compression chamber is provided for each of the five fluid compressing portions of the plungers. Five compression chambers are contained in the body 55 which is secured with the drive means contained in the housing 11.

The body 55 is provided with compression chamber sections 56, 57, 58, 59 and 60, as best shown in FIG. 1. The compression chambers 56 and 60 include intake ports 62 and 66, and exhaust ports 61 and 65. Fluid supply lines are connected with the intake ports 62 and 66 and an output flow stream line is connected with the exhaust ports 61 and 65. Compression chamber sections 57, 58 and 59 are connected together so they require a single intake port 64 and a single exhaust port 63. Accordingly, the compression chamber sections 57, 58 and 59 provide a high pressure output fluid stream flow out the exhaust port 63. A suitable baffle or separating plate is provided between the compression chamber sections 56 and 57 to separate them. The compression chamber section 60 is likewise separate from the adjacent compression chamber section 59.

Conventional bronze disc check valves 67 and 68 are provided for each compression chamber section whereby the valves 68 will allow exhaust from the compression chamber and the valve 67 will allow intake into the compression chamber. The valves 67 and 68 accordingly act in a conventional manner as one-way check valves to allow the pumping action. Other suitable check valves could be substituted for the check valves 67 and 68.

As shown in FIG. 1, the pump apparatus 10 provides three intake ports 62, 64 and 66 and three exhaust ports 61, 63 and 65 whereby the pump will handle three different fluids without intermixing of the fluids. If the stroke of the plungers for the compression chambers 56, 57, 58, 59 and 60 are all the same, then the exhaust port 63 will provide three times the outflow of the exhaust ports 62 and 66. If desired, the fluids may be subsequently mixed into a final output fluid stream formed by suitable conduits (not shown). Each plunger includes a stuffing box 69 to provide a tight seal between the fluid compressing head portion of the plunger. A baffle disc 70 is also provided on each plunger to engage the stuffing box during each compression stroke. Each stuffing box includes a throat bushing 72 packing 73, lantern ring 74, additional packing 75 and a stuffing nut 76 for applying pressure to the stuffing box gaskets. A grease fitting 77 is provided to grease the packings 73 and 75.

A plurality of plugs 71 are screwed into openings in the side and top of each compression chamber section. These plugs can be removed to provide access to the check valve for maintenance purposes.

Figure 2:
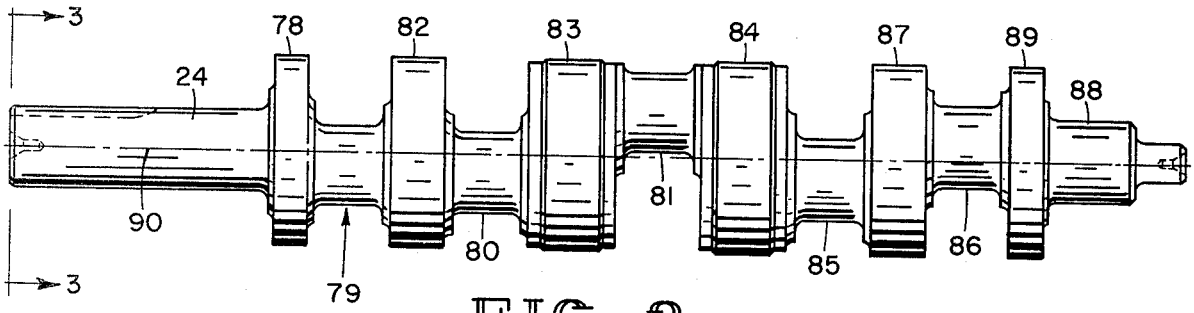
FIG. 2 is an elevation view of the crankshaft of the pump.
Figure 3:
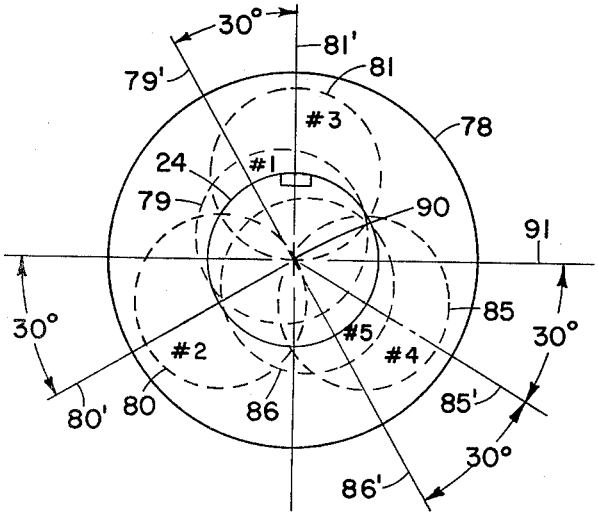
FIG. 3 is a schematic view showing the relative orientation and strokes of the rod-connecting portions of the crankshaft.

Referring now to FIGS. 2 and 3, the detail of the crankshaft 24 is specifically shown. The crankshaft 24 includes a journal member 78 against which the bearing 26 is mounted. The connecting rod 32 is secured on the bearing portion 79. The connecting rod 33 is secured on the bearing portion 80 and the connecting rod 34 is secured on the bearing portion 81. A cheek 82 separates the bearing portions 79 and 80, and a center bearing journal 83 separates the bearing portions 80 and 81. A second center bearing journal 84 is provided for the second center bearing (not shown). A fourth connecting rod bearing portion 85 and a fifth connecting rod bearing portion 86, which are separated by a cheek 87 are provided for the two connecting rods which are not shown. The bearing enclosed by the extension guard 29 is mounted upon the crankshaft support bearing surface 88 adjacent to journal 89.

The relative positions of the bearing portions 79, 80, 81, 85 and 86 are best shown in FIG. 3. The reference symbols from FIG. 2 have been transposed on the schematic drawing shown in FIG. 3 to indicate the relative position of the components of the crankshaft. In particular, the bearing portions 79, 80, 81, 85 and 86 correspond to the designations #1, #2, #3, #4, and #5 as shown in FIG. 3. As will be apparent, the distance of the bearing portions 79 and 86 from the centerline 90 of the crankshaft are less than the distance of the bearing portions 80, 81 and 85 from the centerline. Accordingly, the connecting rods connected with the outer bearing portions 79 and 86 will have a proportionally smaller stroke and will provide less pumping pressure than that of the greater strokes of the bearing portions 80, 81 and 85.

The bearing portions 80, 81 and 85 are spaced 120° apart so that there will be provided an equal interval between each compression stroke for the plungers connected with these bearing portions. The plungers connected to the bearing portions 80, 81 and 85 are considered the high pressure reciprocating plungers which provide a single high pressure output fluid stream. The equal intervals between their compression strokes for each revolution of the crankshaft or drive is important to minimize vibrations and shocks in the high pressure output fluid stream connected with the exhaust port 63. It has been found in practice that, unless the intervals between the compression strokes of the longer stroke high pressure plungers are equally spaced, vibrations, pulsations, and shocks will occur in the high pressure fluid stream causing the whole system to vibrate. Accordingly, in the case of the above-described pump which utilizes three long stroke high pressure plungers and two shorter stroke low pressure plungers, it has been found that the intervals between the compression strokes of the high pressure plungers should be the same with the compression strokes of the lower pressure plungers spaced somewhere between the compression strokes of the high pressure plungers. It has been found in practice that when a conventional crankshaft is utilized, which provides equal intervals between all of the bearing portions, as in the case of the above-described pump, vibrations and shocks will occur apparently due to the uneven intervals of compression strokes for the high pressure output stream.

The angular spacing of the bearing portions shown in FIG. 3 has been found to be preferable for the five plunger multiple fluid pump of the preferred embodiment. In particular, the bearing portions 80, 81 and 85 are spaced 120° apart. The radial line 79' extending through the center of the bearing portion 79 is spaced 30° counter-clockwise from the radial line 81', extending through the center of the bearing portion 81. The radial lines 80' and 84', extending through the center of the bearing portions 80 and 85, respectively, are spaced 30° counter-clockwise and 30° clockwise, respectively, from the horizontal line 91 which is perpendicular to the radial line 81'. The radial line 86', extending through the center of the bearing portion 86, is spaced 30° clockwise from the radial line 85'. As will be apparent, the compression stroke of the low pressure plunger connected to the bearing portion 79 is intermediate that of the compression strokes for the high pressure plungers 80 and 81. The compression stroke for the low pressure plunger connected to the bearing portion 86 is intermediate to the compression strokes for the high pressure plungers connected with the bearing portions 80 and 85. The above-described arrangement provides a pump capable of pumping up to three liquids, one of which is pumped at a high pressure while at the same time minimizing vibrations and shocks in the high pressure output fluid stream of the pump. Accordingly, a single pump with a single crankshaft can be utilized to provide the function of three different pumps, since normally three pumps would be utilized to provide the multiple output fluid stream at varying pressures.

While there has been shown and described a preferred embodiment of the multiple fluid pump in accordance with the invention, it will be appreciated that any changes and modifications may be therein without, however, departing from the essential spirit of the invention within the scope of the claims.

I claim:

1. A pump apparatus providing multiple separate fluid output streams at varying pressures comprising:

a plurality of high pressure fluid compressing piston means connected to a common manifold and driven by a common drive shaft to provide a single fluid output stream at a high pressure;

said high pressure fluid compressing piston means having substantially equal intervals between their compression modes to minimize vibrations and shocks in the high pressure fluid output stream;

at least one low pressure fluid compressing piston means driven by the same common drive shaft as the high pressure fluid compressing piston means to provide a low pressure output fluid stream;

said low pressure fluid compressing piston means having its compression mode intermediate to two of the compression modes of the high pressure fluid compressing piston means to minimize vibrations and shocks in the output streams and pump apparatus;

the drive means comprising a rotary drive shaft; and the rotary drive shaft is a crank having plural bearing portions.

2. The apparatus as set forth in claim 1 wherein:

the low and high pressure fluid compressing means comprise reciprocating plungers.

3. The apparatus as set forth in claim 1 wherein:

the plurality of high pressure fluid compressing means comprising at least three high pressure fluid compressing means.

4. The apparatus as set forth in claim 1 wherein:

at least two low pressure fluid compressing means are provided.

5. A pump apparatus providing multiple separate fluid streams at varying pressures comprising:

a plurality of high pressure fluid compressing piston means connected to a common manifold and driven by a common drive shaft to provide a single fluid output stream at a high pressure;

said high pressure fluid compressing piston means having substantially equal intervals between their compression modes to minimize vibrations and shocks in the high pressure fluid output stream;

at least one low pressure fluid compressing piston means driven by the same common drive shaft as the high pressure fluid compressing piston means to provide a low pressure output fluid stream;

said low pressure fluid compressing piston means having its compression mode intermediate to two of the compression modes of the high pressure fluid compressing piston means to minimize vibrations and shocks in the output streams and pump apparatus; and, the drive means comprising a rotary crank having plural bearing portions for driving the high and low pressure fluid compressing means.

6. The apparatus as set forth in claim 5 wherein:

the bearing portions for the high pressure reciprocating plungers are equally circumferentially spaced to provide equal intervals between the compression strokes of the high pressure fluid compressing means to minimize vibrations and shocks in the high pressure output fluid stream.

7. The apparatus as set forth in the claim 5 wherein:

the bearing portions for the high pressure fluid compressing means are equally radially located from the centerline of the crank to provide equal compression for each of the high pressure fluid compressing means.

8. The apparatus as set forth in claim 7 wherein:

the bearing portion for at least one low pressure fluid compressing means is radially located from the centerline of the crank a lesser amount than the radial location of the high pressure fluid compressing means bearing portions to provide a lesser compression for at least one low pressure fluid compressing means than that of the high pressure fluid compressing means.

9. The apparatus as set forth in the claim 5 wherein:

the bearing portion for the at least one low pressure fluid compressing means is circumferentially located intermediate the circumferential locations of the bearing portions for two of the high pressure fluid compressing means.

10. A pump apparatus for providing multiple separate fluid output streams at varying pressures, comprising:

a rotary crank having plural bearing portions connected with reciprocating rods for driving plural fluid compressing reciprocating plungers connected to a common manifold;

a plurality of the bearing portions being equally radially spaced from the centerline of the rotary crank to provide a plurality of the reciprocating plungers with equal compression strokes;

the reciprocating plungers connected with the equally radially spaced bearing portions being in communication with a single fluid output stream to provide a high pressure fluid output stream;

the bearing portions for the plurality of high pressure plungers being equally circumferentially spaced to provide equal intervals between their compression strokes to minimize vibrations and shocks in the high pressure fluid output stream;

at least one of the bearing portions being radially spaced from the centerline of the rotary crank a lesser amount than the equally radially spaced bearing portions for the high pressure reciprocating plungers to provide a separate low pressure fluid output stream; and the at least one bearing portion which is radially spaced from the centerline of the rotary crank a lesser amount being circumferentially located intermediate the circumferential locations of the bearing portions for the high pressure reciprocating plungers.

11. The apparatus as set forth in claim 10 wherein:

at least three equally radially spaced bearing portions are provided to produce a single high pressure output stream;

at least two lesser equally radially spaced bearing portions are provided to produce two separate low pressure output streams; and the at least two bearing portions are circumferentially located each intermediate two different bearing portions of the at least three bearing portions.

* * * * *